US006405891B1

(12) United States Patent
Christensen et al.

(10) Patent No.: US 6,405,891 B1
(45) Date of Patent: Jun. 18, 2002

(54) UNDERGROUND RAKE STORAGE APPARATUS AND METHOD

(75) Inventors: Warren J. Christensen, 2930 Oakview Cir., Salt Lake City, UT (US) 84121; Jeffrey Christensen, Sandy, UT (US); Kip M. Colton, West Valley City, UT (US); Stephen Matthew Haws; Michelle Elaine Lau, both of Provo, UT (US); Janet Heidemarie Lehnardt, Springville, UT (US); Kevin David Staples; Alaa Abu-Obeid, both of Provo, UT (US); Len Pugh, Mapleton, UT (US)

(73) Assignee: Warren J. Christensen, Salt Lake City, UT (US)

( * ) Notice: Subject to any disclaimer, the term of this patent is extended or adjusted under 35 U.S.C. 154(b) by 0 days.

(21) Appl. No.: 09/840,391

(22) Filed: Apr. 23, 2001

(51) Int. Cl.[7] ..... B65D 25/00
(52) U.S. Cl. ..... 220/484
(58) Field of Search ..... 220/484, 501; 206/244, 315.2, 349, 443

(56) References Cited

U.S. PATENT DOCUMENTS 2,436,631 A * 2/1948 Cohn ..... 220/484 X
2,528,056 A * 10/1950 Henry ..... 220/484
2,757,045 A * 7/1956 Nullet ..... 220/18 X
2,791,347 A * 5/1957 Bochm ..... 220/18 X
2,857,863 A * 10/1958 Dwyer ..... 220/484 X
3,233,367 A * 2/1966 Hagle ..... 220/484 X
3,515,263 A * 6/1970 Carlson ..... 220/18 X
3,584,739 A 6/1971 Erichson
4,669,625 A 6/1987 Armstrong
4,838,416 A * 6/1989 Carman ..... 206/315.2
4,934,550 A 6/1990 Cash
5,042,812 A 8/1991 Tillman
5,735,430 A 4/1998 Gorman
6,223,926 B1 * 5/2001 Craven et al. ..... 220/484
6,308,854 B2 * 10/2001 Craven et al. ..... 220/484

* cited by examiner

*Primary Examiner*—Steven Pollard
(74) *Attorney, Agent, or Firm*—Thorpe North & Western

(57) ABSTRACT

A rake storage device for storing a rake adjacent a sand trap of a golf course, and for selectively elevating the rake for use, includes an elongated container disposed underground in a substantially vertical orientation. The rake is removably received within the container. The device includes lifting means for elevating the rake out of the container and above the surface. The lifting means can include a rake receiver and a counter-weight operatively coupled together and movably disposed in the elongated container.

33 Claims, 7 Drawing Sheets

UNDERGROUND RAKE STORAGE APPARATUS AND METHOD

BACKGROUND OF THE INVENTION

1. Field of the Invention

The present invention relates generally to a method and apparatus for storing a rake adjacent a sand trap of a golf course, and for selectively elevating the rake for use.

2. Related Art

Golf courses are typically provided with hazards, such as sand traps which are disposed about the greens and fairways of the golf course. During play, golf balls are often shot into a sand trap. In order to continue play, the player must enter the sand trap and shoot the golf ball out. Playing the ball from the sand trap leaves footprints in the sand, and creates a divot from the swing. These disturbances in the sand trap, if left unattended, can affect the roll of the next ball hit into the sand trap. As a courtesy to other players and/or under the rules of the game, the player must leave the sand trap in its original or undisturbed condition. For this purpose, one or more rakes typically are provided at each sand trap. The player can use the rake to smooth the sand in the sand trap.

Leaving rakes along side or in the sand traps results in numerous disadvantages. One disadvantage of leaving rakes along side a sand trap is the potential that a golf ball will strike the rake, and thus interfere with the shot. In addition, rakes left along side the sand trap are esthetically displeasing. In addition, such rakes may present a safety hazard to players who might inadvertently step on, or trip over, the rake. In addition, golf carts may inadvertently run over and break the rake. Furthermore, maintenance of the course is made more difficult as workers must move the rakes as they mow the course, and/or tractor-rake the sand trap. Another disadvantage of leaving rakes about the sand trap is that such rakes tend to migrate to one end or location of the sand trap. In addition, sunlight tends to destroy the fiberglass handle of rakes that are left out.

Various devices have been developed in an attempt to solve the above-mentioned problems. For example, U.S. Pat. No. 3,584,739 issued to Erichson discloses a container buried in the ground adjacent the sand trap with a hinged cover having an artificial turf surface. When not in use, the rake is stored in a horizontal orientation in the container. As further examples, U.S. Pat. No. 4,934,550 issued to Cash, and U.S. Pat. No. 5,042,812 issued to Tillman, both disclose a container buried under the ground surface. One disadvantage with these types of underground containers is the difficulty and inconvenience of retrieving the rake from the underground container. For example, the player may have to bend over, squat, or kneel to withdraw the rake from the container. Alternatively, the player may have to fish the rake out of the container by hooking part of the rake with a golf club and carefully raising the rake to a position in which it may be grasped.

SUMMARY OF THE INVENTION

It has been recognized that it would be advantageous to develop a system or method for storing a rake adjacent a sand trap of a golf course in such a way as to minimize any interference of the rake with play, speed up play, increase the esthetic appearance of the course, improve the safety of the players, and increase the efficiency of course maintenance. In addition, it has been recognized that it would be advantageous to develop a system or method for more easily retrieving the rake for use, and returning for storage.

The invention provides an underground rake storage system to store a rake adjacent a sand trap of a golf course, and advantageously to selectively elevate the rake for use. Preferably, the system utilized a rake with a typical configuration, or having a handle with proximal and distal ends, and a head disposed on the distal end. The system includes an elongated container to removably receive the rake therein, and which is disposed underground in a substantially vertical orientation. The container can include a main tube to receive the handle of the rake, and a tray disposed on the main tube to receive the head of the rake.

A lifting mechanism advantageously is disposed in the container to vertically elevate the rake. The lifting mechanism preferably elevates the head of the rake to a convenient grasping elevation, such as greater than approximately two feet. In addition, the lifting mechanism preferably moves the rake between a storage elevation, and a graspable elevation. In the storage elevation, the rake is disposed underground, and within the container. In the graspable elevation, the head is disposed out of the container, and above the ground.

In accordance with a more detailed aspect of the present invention, the system includes a counter-weight system to elevate the rake. The counter-weight system includes a receiver to receive the rake, and a counter-weight to elevate the receiver and rake. The receiver and counter-weight are movably disposed in the elongated container. A pulley can be disposed within the elongated container with a cord movably engaging the pulley, and attached to the receiver and the counter-weight.

In accordance with another more detailed aspect of the present invention, the system may include a latching mechanism for selectively retaining the rake in the container, and/or selectively activating the lifting mechanism. A bi-stable mechanism can be used which is engagable by the rake, and movable between a secure position, and an open position. In the secure position, the mechanism retains the rake within the container. In the open position, the mechanism allows the rake to be removed from the container. A pivot member can be pivotally coupled to the container, and engagable by the rake. A spring element can be disposed in the container and engagable by the pivot member to bias the pivot member between two positions.

A method for using the underground rake storage device, or for substantially concealing and selectively providing the rake adjacent the sand trap of the golf course, includes providing the elongated container underground adjacent the sand trap of the golf course in a substantially vertical orientation. The rake is selectively disposed in the container such that the rake is disposed underground in a substantially vertical orientation. The rake is selectively elevated out of the container in a substantially vertical direction, and substantially along a longitudinal axis of the rake.

Additional features and advantages of the invention will be apparent from the detailed description which follows, taken in conjunction with the accompanying drawings, which together illustrate, by way of example, features of the invention.

DETAILED DESCRIPTION

Figure 1:
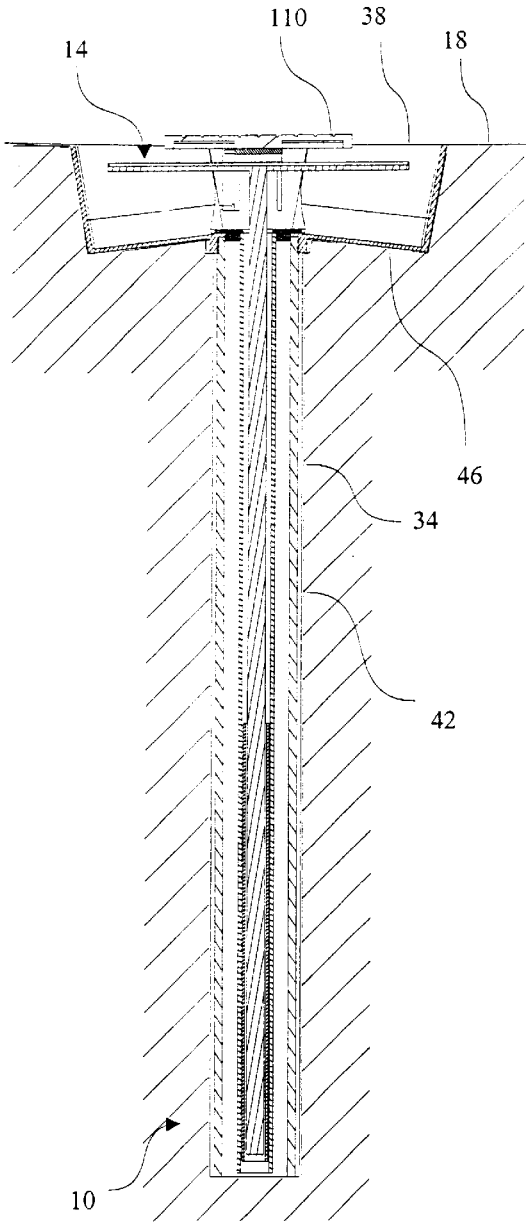
FIG. 1 is a cross-sectional front view of a rake storage device or system in accordance with the present invention with a rake in a retracted or concealed position.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

As illustrated in FIGS. 1–4, a rake storage system or device, indicated generally at 10, is shown for storing a rake 14 adjacent a sand trap of a golf course. Preferably the system 10 is configured to store the rake 14 underground, or substantially under a surface 18 of the golf course. Golf courses and rakes are examples of fields that may benefit from the use of the rake storage system 10. The rake 14 can have a typically configuration with an elongated handle 22 having a proximal end which is grasped by the user, and a head 26 formed on a distal end thereof for contacting and manipulating the sand. The rake 14 also has a longitudinal axis 30, which generally is parallel and concentric with the handle 22. The head 26 of the rake 14 can include a plurality of fingers along one edge, and a substantially continuous edge opposite the fingers, to rake the sand of the sand trap. It is of course understood that the rake 14 can have various different configurations.

The rake storage system or device 10 also includes an elongated container 34 configured to removably receive the rake 14 therein. The elongated container 34 is disposed underground, or under the surface 18 to conceal and/or position the container 34 and rake 14. The container 34 includes an opening 38 through which the rake 14 passes into, and out of, the container 34. The opening 38 preferably is located at the end or top of the elongated container 34. The top of the container 34 or opening 38 preferably is located generally flush with the surface 18. Thus, the rake 14 and container 34 are located underground to avoid interference with play, and improve aesthetics, while still remaining visible to facilitate locating the rake when needed.

Preferably the container 34 is configured to substantially match the shape or configuration of the rake 14. The container 34 may include an elongated main tube 42, and a trough or tray 46 disposed at the end of the main tube 42. The main tube 42 is configured to receive the handle 22 of the rake 14, while the tray 46 is configured to receive the head 26. The opening 38 of the container 34 may be formed in the tray 46.

Figure 2:
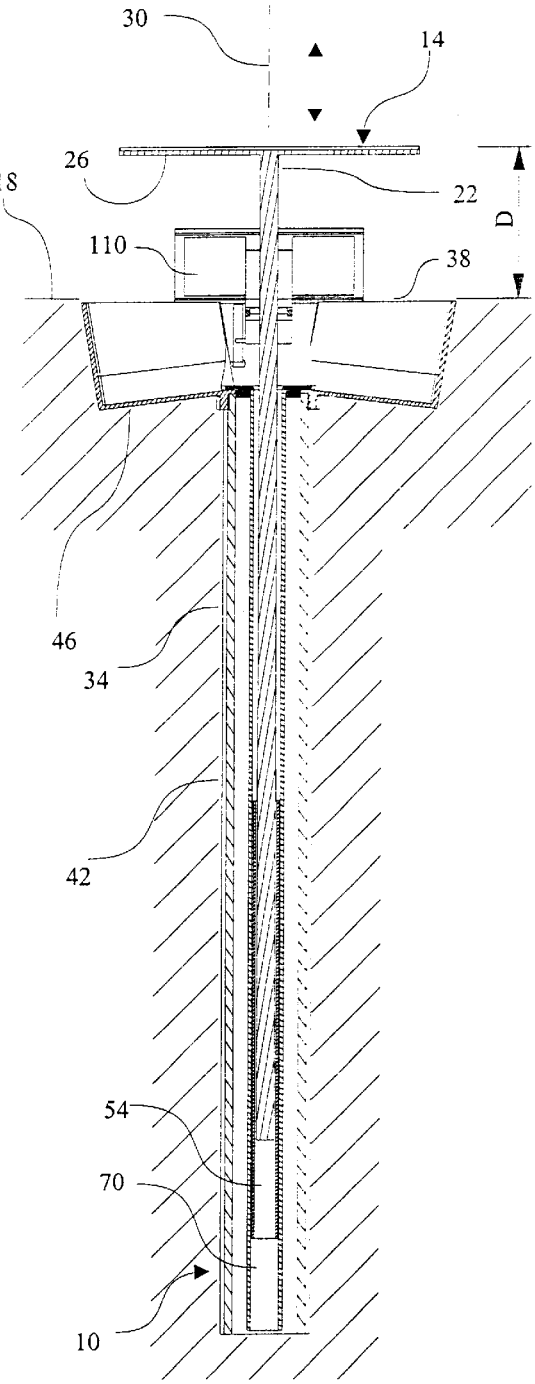
FIG. 2 is a cross-sectional front view of the rake storage device or system of FIG. 1 with the rake shown in an elevated position.
Figure 3:
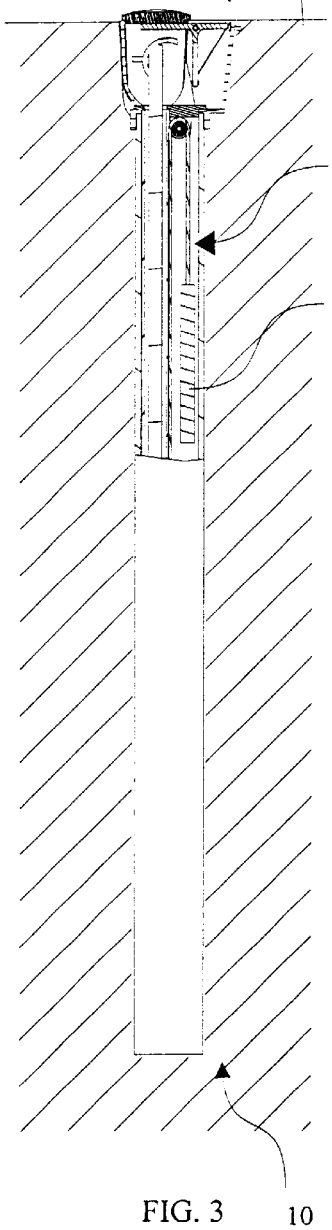
FIG. 3 is a partial cross-sectional side view of the rake storage device or system of FIG. 1 with the rake shown in the retracted or concealed position.
Figure 4:
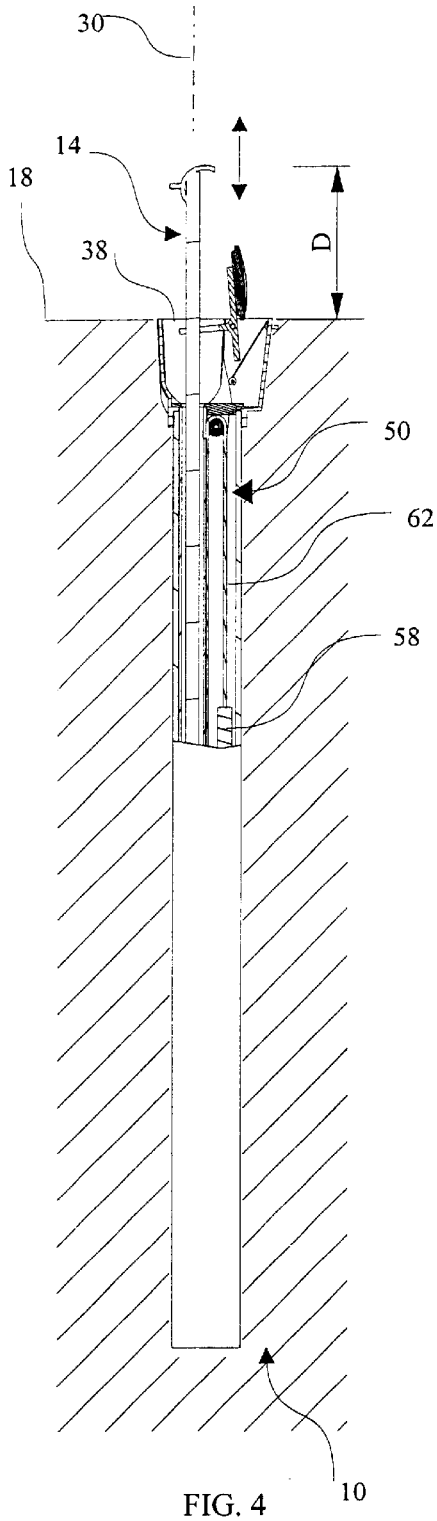
FIG. 4 is a partial cross-sectional side view of the rake storage device or system of FIG. 1 with the rake shown in the elevated or extended position.

The underground rake storage system or device 10 of the present invention advantageously includes a lifting mechanism to vertically elevate the rake 14, or eject the rake 14 from the container 34. Referring to FIGS. 3 and 4, the lifting mechanism advantageously can include a counter weight system 50. A receiver or receiver tube 54 (FIG. 2) can be moveably disposed in the elongated container 34 or main tube 42 to receive the proximal end of the rake 14 therein. The receiver 42 can be operatively coupled to a counter weight 58, which is also movably disposed in the elongated container 34 or main tube 42. The counter weight 58 operates to elevate the receiver 54 (FIG. 2), and thus the rake 14. The receiver 54 (FIG. 2) and the counter weight 58 may be operatively coupled by a cord 62. The cord 62 in turn may operatively engage a pulley 66 (best shown in FIGS. 6*a* and 6*b*) disposed near the top of the elongated container 34 or at the top of the main tube 42.

The receiver 54 and the counter weight 58 move or slide up and down within the main tube 42. The cord and pulley 62 and 66 cause the receiver 54 and counter weight 58 to move in different directions, with the counter weight 58 moving in a downward direction as the receiver 54 moves in an upward direction, and vise versa.

The counter weight 58 preferably has a weight, which is greater than a combined weight of both the rake 14 and receiver 54. Thus, the counter weight 58 tends to move in a downward direction under the force of gravity causing the receiver 54 with the rake 14 therein to move in an upward direction. Preferably, the counter weight 58 weighs only slightly more than both the rake 14 and receiver 54 to cause the receiver 54 and rake 14 to move upwardly in a slow, smooth motion. The slow motion or elevation of the rake 14 resists surprise or possible injury.

The lifting mechanism preferably is configured to elevate the rake 14 a significant distance to facilitate retrieval of the rake 14 from the container 34. Preferably, the lifting mechanism elevates the head 26 of the rake 14 to a convenient, graspable elevation greater than approximately 2 feet, and more preferably greater than approximately 3 feet. It will be appreciated that the counter weight system 50 can be configured to elevate the rake 14 a desired distance, which is limited by the length of the cord 62 and the length of the counter weight 58 in the length of the main tube 42. Thus, the length of the cord 62 and counter weight 58 can be selected such that the head 26 of the rake 14 is elevated to the desired elevation.

Figure 5:
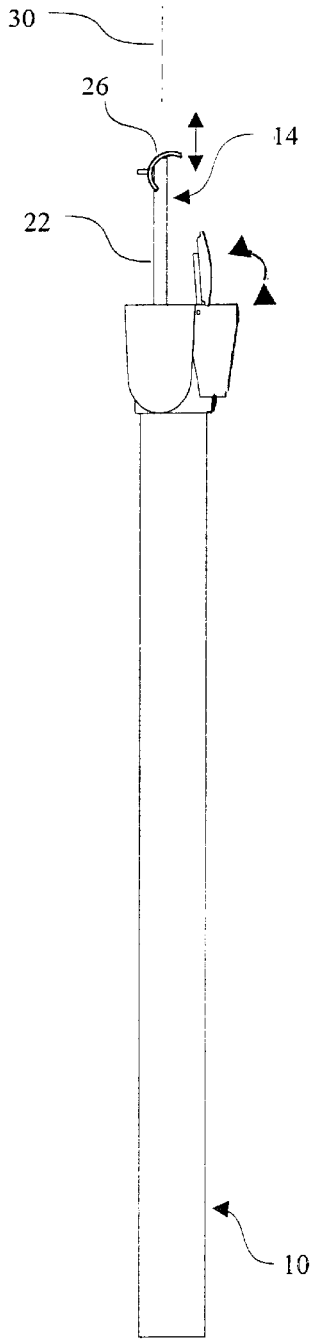
FIG. 5 is a side view of the rake storage device or system of FIG. 1 with the rake shown in the elevated or extended position.

The lifting mechanism of the present invention provides a significant advantage over prior art rake storage systems in that the user is not required to bend over, kneel, or squat in order to retrieve the rake 14 from the container 34. The lifting mechanism advantageously elevates the rake 14 to an elevation where the user may easily grasp the rake 14, handle 22 or head 26 thereof The lifting mechanism or counter weight system 50 moves or displaces the rake between a storage elevation, as shown in FIGS. 1 and 3, and a graspable elevation, as shown in FIGS. 2, 4 and 5. In the storage elevation, the rake 14 is disposed under the surface 18, and within the container 34. At the graspable elevation, the head 26 of the rake 14 is disposed above the surface 18, and out of the container 34.

As stated above, the container 34 and rake 14 preferably are disposed in a vertical orientation. Therefore, the lifting mechanism or counter weight system 50 advantageously elevates the rake in a vertical direction, and along the longitudinal axis 30 of the rake 14. Thus, the length of the rake 14 or the handle 22 itself is utilized in providing the rake 14 or head 26 thereof at a graspable elevation.

Although the container 34 and rake 14 are shown in a vertical orientation, it is of course understood that the rake 14 and container 34 can be disposed at a vertical incline, or at an angle with respect to the surface 18. Such a configuration might be useful if the system 10 is disposed in an angled side of a sand trap or bunker.

An additional advantage of the counter weight system 50 is that the counter weight 58 and pulley 66 can be configured such that the rake 14 is slowly elevated out of the container. It will be appreciated that the counter weight system 50 causes the rake 14 to slowly elevate as the counter weight 58 slowly overcomes its inertia and builds momentum. The slow elevation of the rake 14 advantageously allows the user time to react and grasp the rake. In addition, such slow displacement resists surprises and/or injury.

The counter weight system 50 is one example of a lifting mechanism or a means for elevating the rake 14. It is of course understood that other means for elevating the rake 14 may be used, including for example, an electric motor, hydraulics, a hydraulic actuator, a hydraulic motor, pneumatics, a pneumatic actuator, a pneumatic motor, a spring or other stored energy force, etc.

Referring again to FIG. 2, a guide tube 70 or guide track may be disposed in the main tube 42. The receiver or receiver tube 54 can be slideably disposed in the guide tube 70. The guide tube 70 prevents the receiver 54 and counter weight 58 from interfering with one another as they move.

The underground rake storage system or device 10 also advantageously includes a latching mechanism to selectively or releasably secure the rake 14 in the container 34. The latching mechanism operates to prevent the lifting mechanism or counter weight system 50 from elevating the rake 14 out of the container 34 until desired. The latching mechanism may engage the rake 14 to prevent the rake from exiting the container 34, or may engage the lifting mechanism or counter weight system 50 to prevent the lifting mechanism or counter weight system 50 from operating.

Figure 6C:
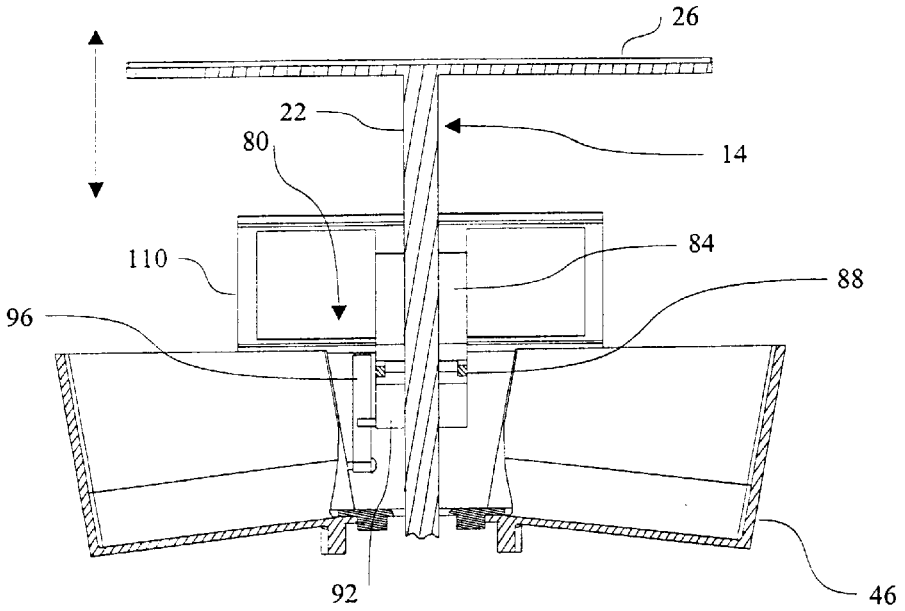
FIG. 6*c* is a partial cross-section front view of the rake storage device or system of FIG. 1 with the rake shown in the extended or elevated position.
Figure 6B:
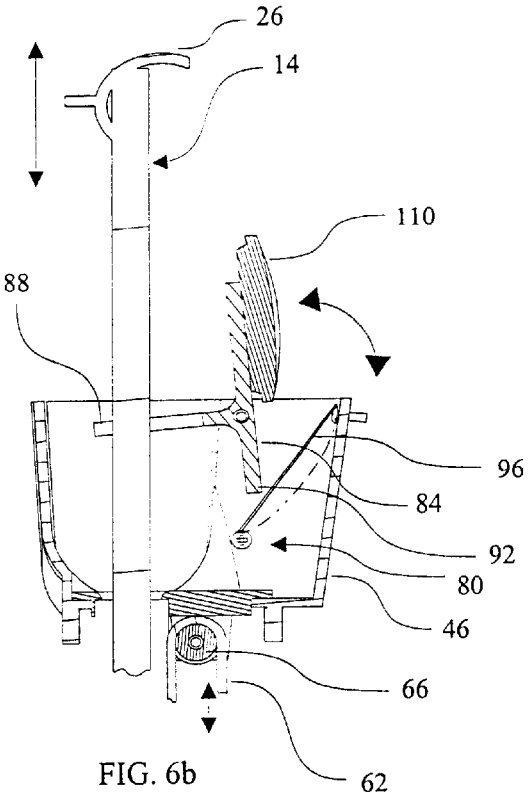
FIG. 6*b* is a partial cross-sectional side view of the rake storage device or system of FIG. 1 with the rake shown in the extended or elevated position.
Figure 6A:
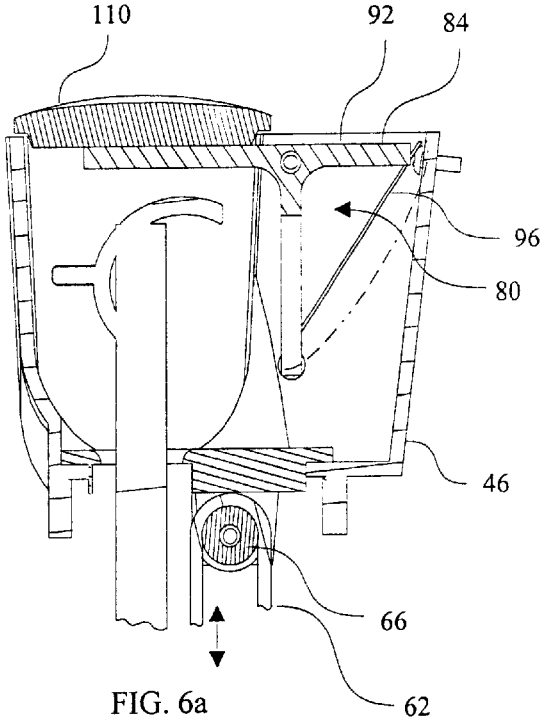
FIG. 6*a* is a partial cross-sectional side view of the rake storage device or system of FIG. 1 with the rake in the retracted or concealed position.
Figure 7:
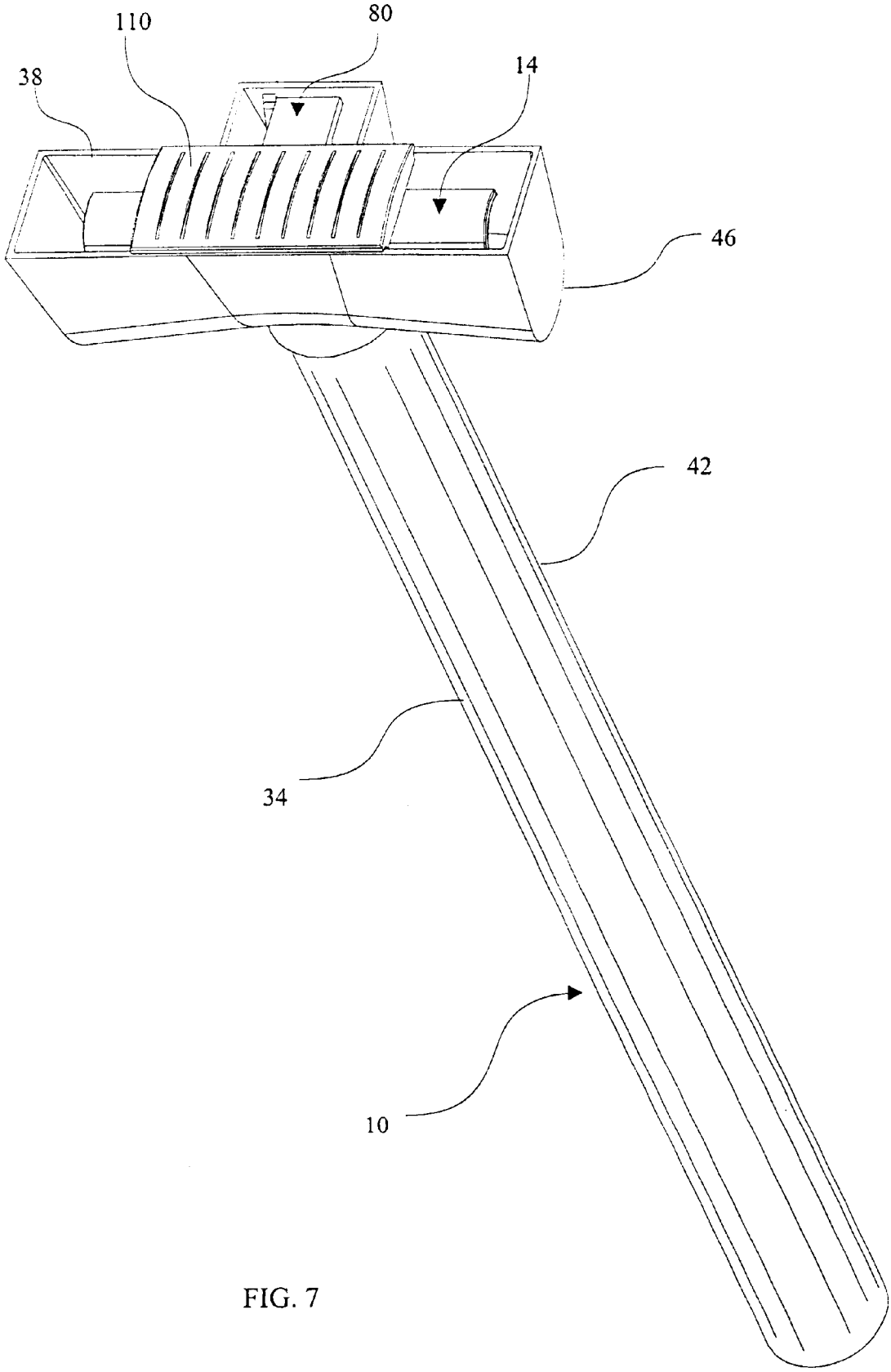
FIG. 7 is a prospective view of the rake storage device or system of FIG. 1.

Referring to FIGS. 6*a* through 6*c*, a bi-stable mechanism 80 is shown disposed in the tray 46 for engaging the rake 14. The bi-stable mechanism 80 preferably has only two stable positions, and thus tends to move to either of the two stable positions. The two stable positions of the bi-stable mechanism 80 preferably correspond to a secure position, as shown in FIG. 6*a*, and an open position as shown in FIG. 6*b*. In the secure position, the mechanism 80 operates to retain the rake 14 within the container 34. In the open position, the mechanism 80 allows the rake 14 to be removed from the container 34, or allows the lifting mechanism to elevate the rake 14.

The bi-stable mechanism can include a pivot member 84 pivotally coupled to the container 34 or tray 46. The pivot member 84 can include an engagement portion or arm 88, which is pivotal into the path of travel of the rake 14, and engagable by the rake 14 or head 26, as shown in FIG. 6*b*. The engagement portion 88 may be forked to receive the handle 22 of the rake 14 therebetween, as shown in FIG. 6*c*. The pivot member 84 also includes a bias portion or arm 92, which engages a spring element 96. The bias portion 92 engages the spring element 96 as the pivot member 84 pivots. The spring element 96 may be a leaf spring attached to the container 34 or tray 46. The bias portion 92 of the pivot member 84 causes the spring element 96 to bend or deflect, as shown in dashed lines, as the bias portion 92 tracks along the spring element 96. Thus, the spring element 96 tends to force the pivot member 84 towards either of the two positions, and provides resistance to movement of the pivot member 84 out of either of the two positions.

In use, placing the rake 14 in the container 34 causes the head 26 to contact the engaging portion 88 of the pivot member 84, causing the pivot member 84 to pivot towards the closed position. Pivoting the pivot member 84 in the opposite direction allows the rake 14 to be withdrawn.

The bi-stable mechanism 80 is one example of a latching mechanism or retaining means for selectively and/or positively retaining the rake 14 within the container 34, and/or for selectively activating the lifting mechanism. It is of course understood that other retaining means for selectively retaining the rake 14 in the container 34 can be used, including for example, a pressure release catch, magnetic latch, a two-way latch, etc. As stated above, the latching mechanism may be configured to engage the rake 14 itself, or can be configured to engage the lifting mechanism or counter weight system 50. For example, a pressure release catch or magnetic latch may be disposed in the bottom of the container 34 or main tube 42 to engage and releasably secure the receiver 54, and thus selectively prevent movement of the counter weight.

A lid 110 may be pivotally attached to the container 34 or tray 46. The lid 110 may be sized and configured to wholly or partially cover the opening 38 of the tray 46 or container 34. Preferably, the lid 110 extends over at least the main tube 42 to resist water and debris from entering the main tube 42. The lid 110 may be secured to the pivot member 84 in order to operate in conjunction with the latching mechanism. Thus, the lid 110 is disposed over the rake 14 in the closed position to prevent withdrawal of the rake 14 from the container 34, or to prevent the lifting mechanism from elevating the rake 14.

The lid 110 has an upper surface that preferably is sized to have indicia thereon. The indicia can include information and/or advertising, including for example, the distance to the hole or green, the name of the course, the name or logo of a sponsor or advertiser, etc.

Referring to FIG. 6*c* the tray 46 may be configured with a bottom wall which tapers downwardly away from the center of the tray 46, and thus away from the opening in the main tube 42, to prevent water and debris from being directed into the main tube 42.

Figure 8:
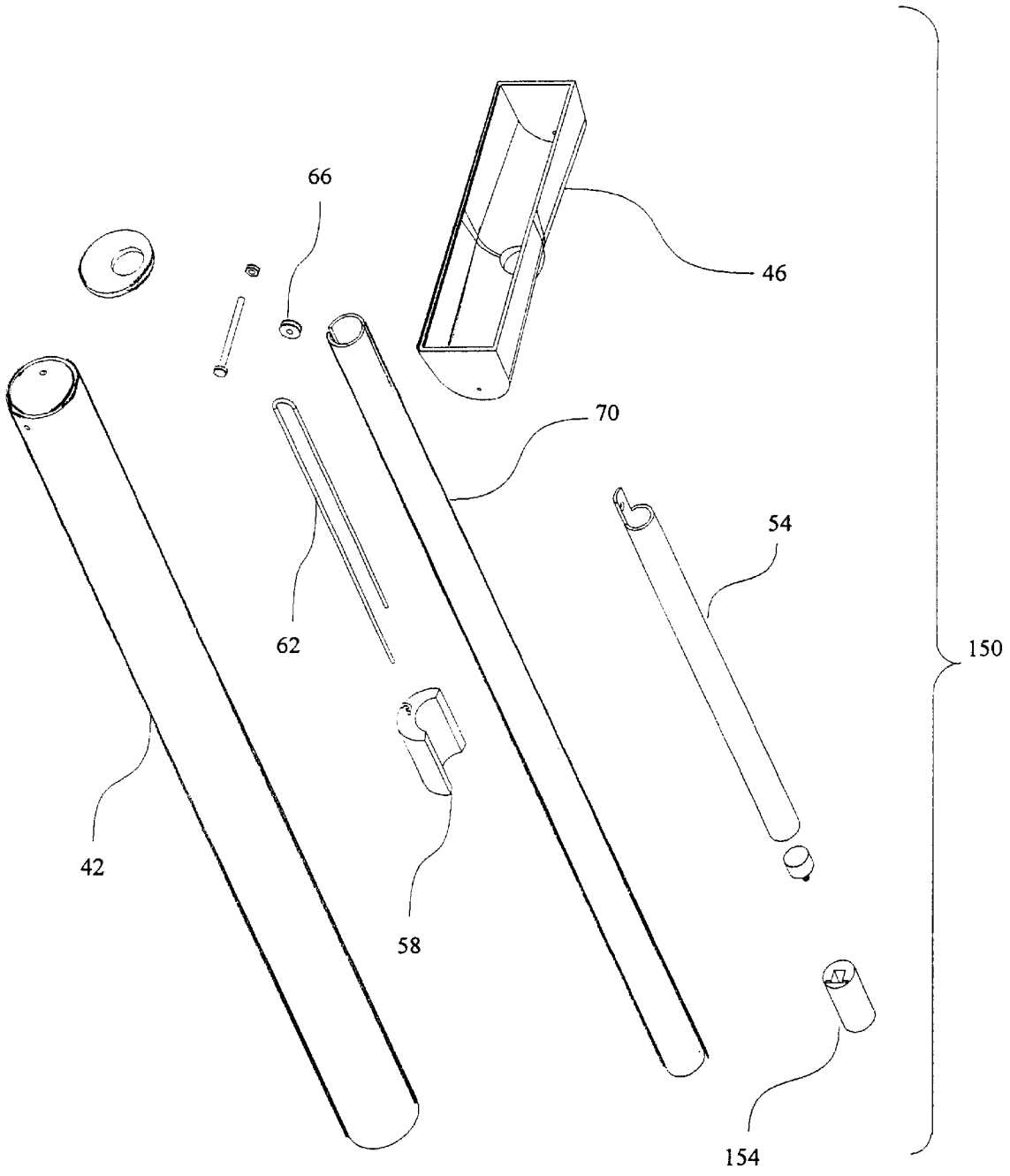
FIG. 8 is an exploded view of another rake storage device or system in accordance with the present invention.

Referring to FIG. 8, another underground rake storage device, indicated generally at 150 is shown which is similar in many respects to the device described above. The device 150 includes a two-way latch or pressure release latch 154, which is disposed in the bottom of the main tube 42 or in the bottom of the guide tube 70. The two-way latch or pressure release latch 154 is engaged by the receiver 54. Such catches or latches respond to unidirectional pressure to both engage and disengage. Thus, forcing the receiver 54 against the latch causes the latch to operate to engage the receiver, while again forcing the receiver 54 against the latch causes the latch to operate to disengage the receiver.

In use, the proximal end of the rake 14 can be inserted into the receiver 54 and pushed into the container 34. When the rake 14 is received within the container 34, the receiver 54 engages the two-way latch or pressure release latch 154 maintaining the rake 14 in the container 34.

When it is desired to remove the rake, a downward force or pressure on the rake 14 presses or forces the receiver 54 against the two-way latch or pressure release latch 154 causing it to release the receiver 54 so that the lifting mechanism or counter weight system 50 can elevate the rake 14.

In addition, the counter weight 58 can have a crescent shaped cross-section. Thus, the counter weight 58 can have an outer concaved surface shaped to match the main tube 42, and an inner convex surface configured to match the guide tube 70. Thus, the counter weight 58 is shaped to maximize the lateral space in the main tube 42, thus reducing its length and maximizing lift.

Figure 9:
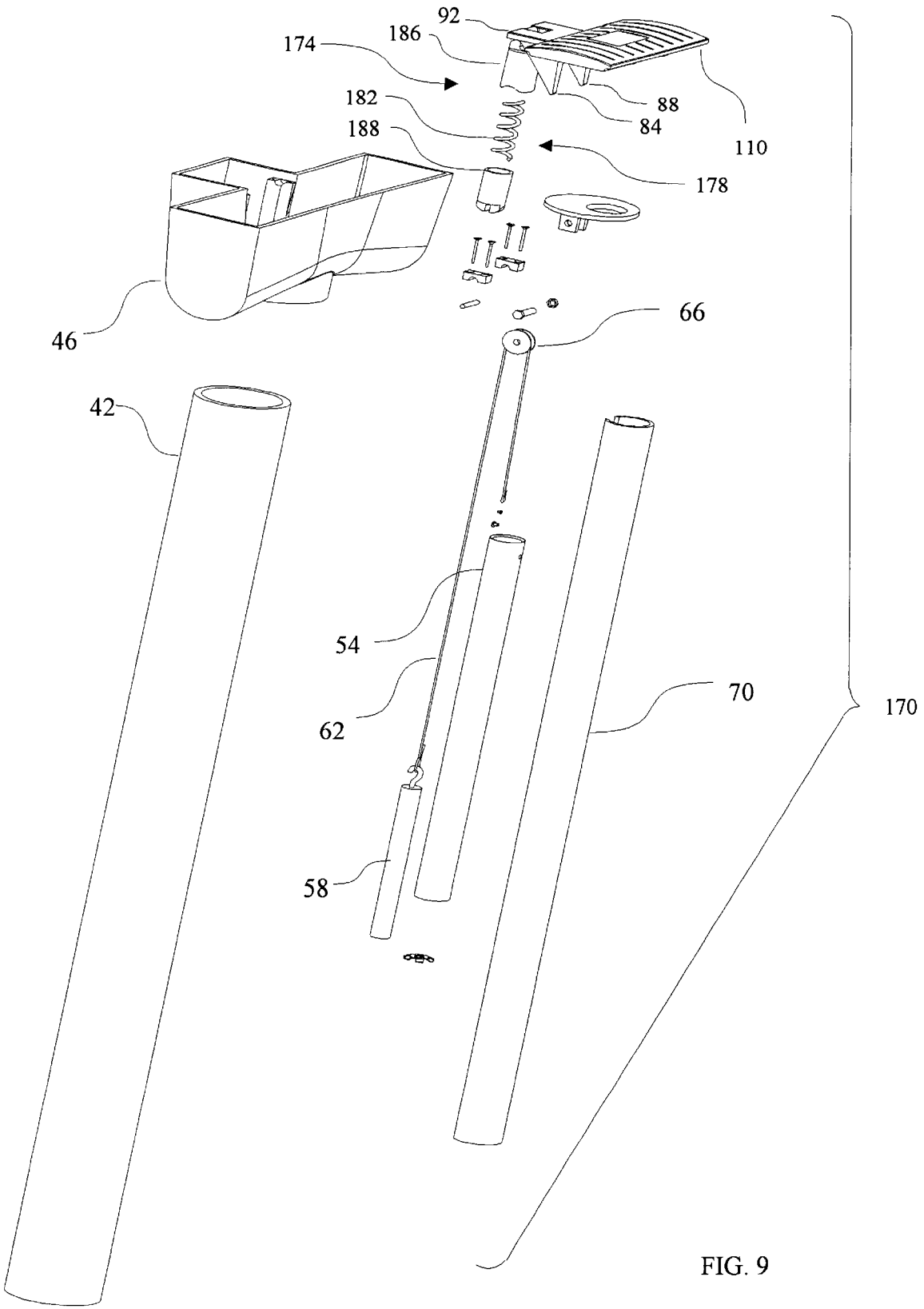
FIG. 9 is an exploded view of another rake storage device or system in accordance with the present invention.

Referring to FIG. 9, another underground rake storage device, indicated generally at 170 is shown which is similar in many respects to the devices described above. The device 170 includes a bi-stable mechanism 174 that has a similar operation, but different structural configuration, to the bi-stable mechanism 80 described above. The bi-stable mechanism 170 preferably has only two stable positions, and thus tends to move to either of the two stable positions. The two stable positions of the bi-stable mechanism 170 preferably correspond to a secure position, and an open position. In the secure position, the mechanism 170 operates to retain the rake 14 within the container 34. In the open position, the mechanism 170 allows the rake 14 to be removed from the container 34, or allows the lifting mechanism to elevate the rake 14.

The bi-stable mechanism 170 is disposed in the tray 46, and can include portions of the lid 110. As described above, the bi-stable mechanism 170 can include a pivot member 84 pivotally coupled to the container 34 or tray 46. The pivot member 84 can include an engagement portion or arm 88, which is pivotal into the path of travel of the rake 14, and engagable by the rake 14 or head 26. The engagement portion 88 may be forked to receive the handle 22 of the rake 14 therebetween. The pivot member 84 also includes a bias portion or arm 92, which engages a biasing mechanism 178.

Figure 10:
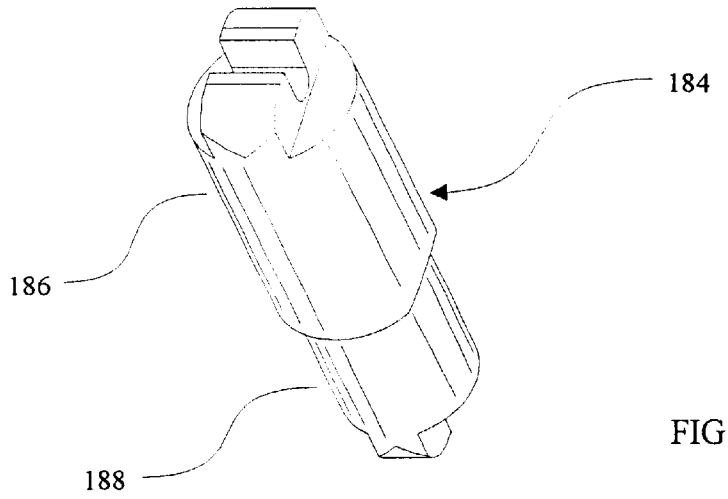
FIG. 10 is a perspective view of a bi-stable mechanism of the rake storage device of system of FIG. 9.
Figure 11:
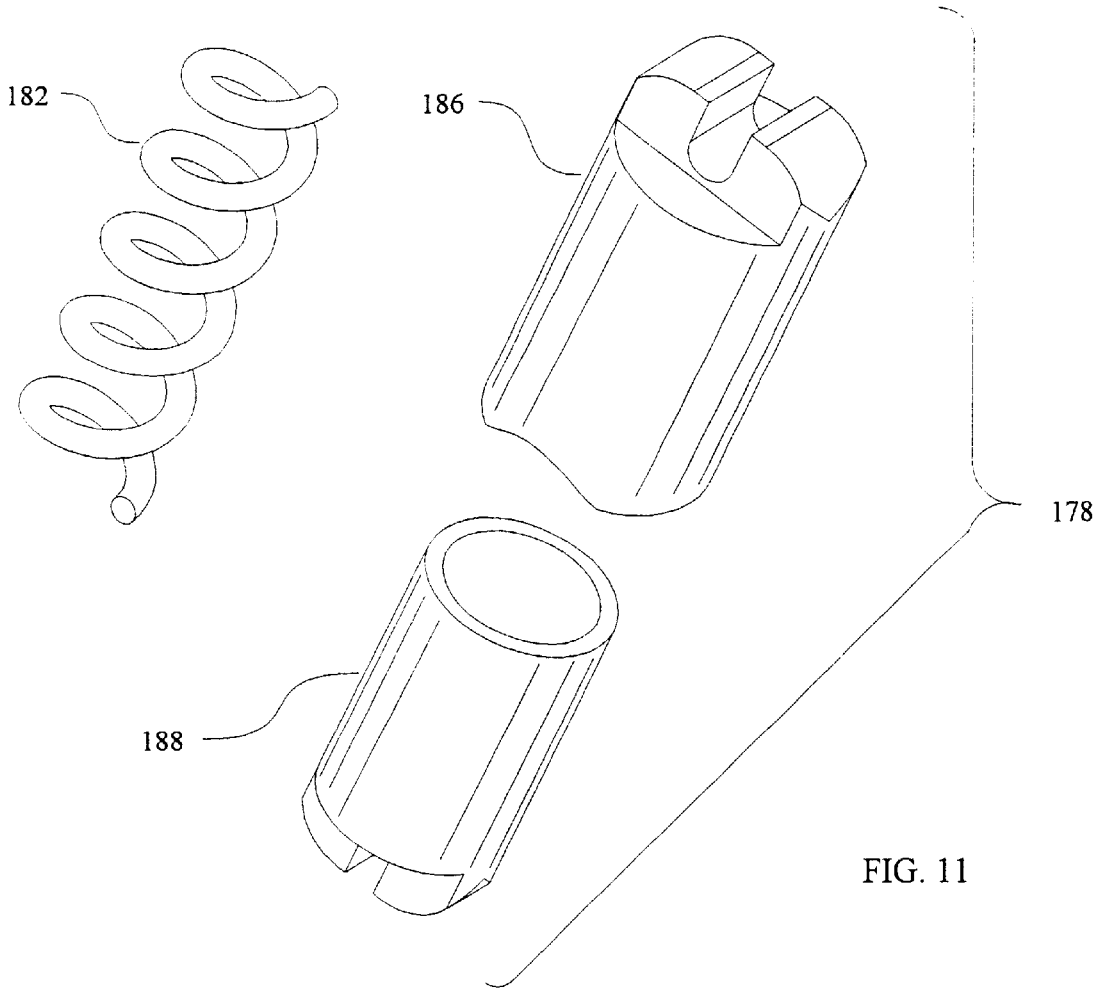
FIG. 11 is an exploded view of the bi-stable mechanism of FIG. 10.

Referring to FIGS. 10 and 11, the biasing mechanism 178 can include a compression spring or coil spring 182. The spring 182 can be contained in a housing 184 to protect the spring 182, maintain the linear compression and expansion of the spring, and provide attachment of the spring. The housing can include first and second portions 186 and 188 which slide or move with respect to each other as the spring is compressed and expanded. The first portion 186 can be pivotally attached to the biasing portion or arm 92 of the pivot member 84, while the second portion can be pivotally attached to the container 34 or tray 46. The bias portion 92 of the pivot member 84 causes the spring 182 to compress as the pivoting member 84 pivots. Thus, the spring 182 or biasing mechanism 178 tends to force the pivot member 84 towards either of the two positions, and provides resistance to movement of the pivot member 84 out of either of the two positions.

The bi-stable mechanism 170 is another example of a latching mechanism or retaining means for selectively and/or positively retaining the rake 14 within the container 34, and/or for selectively activating the lifting mechanism.

A method for using the systems or devices described above, and for substantially concealing and selectively providing the rake 14 adjacent the sand trap of the golf course, includes disposing the elongated container 34 underground, or under the surface 18, adjacent the sand trap of the golf course. As stated above, the elongated container 34 preferably is vertically oriented, but may also be vertically inclined.

In addition, the rake 14 is selectively disposed in the container 34, and thus the rake 14 also is disposed underground or under the surface 18. Similarly, the rake 14 preferably is vertically oriented underground within the container, but may be vertically inclined.

The rake 14 may be disposed in the container 34 by inserting the handle 22 of the rake 14 through the opening 38 of the container 34. The rake 14 is preferably inserted with the handle 22 first. The rake 14 may continue to be inserted to the container 34 until the handle 22 is substantially received in the main tube 42, while the head of the rake 14 is received within the tray 46.

In addition, the rake 14 may be inserted in the container 34 by placing the proximal end of the handle 22 into the receiver or receiver tube 54. It will be appreciated that prior to receiving the rake 14, the receiver or receiver tube 54 will be located near the upper end of the container or main tube 42. For example, the counter weight 58, which weighs more than the receiver or receiver tube 54, will cause the counter weight 58 to move towards the bottom of the container 34 or main tube 42, thus lifting the receiver or receiver tube 54 near the top.

Due to the lifting mechanism, such as the counter weight system 50, it may be necessary to exert a downward force on the rake 14 in order to insert the rake 14 into the container 34. Therefore, the rake 14 advantageously is prevented from merely dropping into the container, thus resisting damage. The users may exert a force on the rake 14 using their hands initially, and then complete the act of inserting the rake into the container using their foot or a golf club.

As the head 26 of the rake 14 is inserted into the tray 46 of the container 34, the head 26 may engage the latching mechanism, such as the bi-stable mechanism 80 or 170. The head 26 may contact the engagement portion 88 of the pivot member 84 as the head 26 enters the tray 46 causing the pivot member 84 to pivot, and causing the bias portion 92 to track or exert a force on the spring element 96, or on the spring 182 or biasing mechanism 178. As the head 26 continues the move into the tray 46, and as the pivot member 84 continues to pivot, the spring element 96 or spring 182 causes the pivot member 84 to completely pivot into the closed or retaining position to maintain the rake 14 in the container 34. For example, the lid 110 may be disposed over the tray 46 and rake 14 to prevent withdrawal of the rake 14. In addition, the latch mechanism, such as the bi-stable mechanism 80 or 170, prevents the lifting mechanism, such as the counter weight system 50, from elevating the rake 14 out of the container 34.

It is of course understood that other latching mechanisms may be used. For example, as the receiver or receiver tube 54 nears the bottom of the container 34 or main tube 42 it may engage a two-way latch or pressure sensitive latch 154, which prevents the counter weight system 50 from elevating the rake 14.

When needed, the rake 14 is selectively elevated out of the container 34 by a lifting mechanism, such as the counter weight system 50. The rake 14 preferably is elevated in a substantially vertical direction, and substantially along its longitudinal axis 30. Thus, the length and orientation of the rake 14 facilitates elevating the rake 14 to a convenient elevation. As stated above, the head 26 of the rake 14 preferably is elevated to a grasping elevation greater than 2 or 3 feet.

To elevate the rake 14, it may be necessary to engage or disengage the latching mechanism. For example, the bi-stable mechanism 80 or 170 may be pivoted towards the open or release position. The user may pivot the pivot member 84 by pressing downwardly on the bias portion 92 with a golf club or foot, or by lifting upwardly on the lid 110 with the golf club. As the pivot member 84 is pivoted, the spring element 96 or spring 182 causes the pivot member 84 to pivot fully to the open position. In addition, the lid 110 is pivoted from above the rake 14 allowing the lifting mechanism, such as the counter weight system 50, to elevate the rake 14.

As stated above, the weight of the counter weight 58 preferably is slightly greater than the combined weight of the rake 14 and the receiver or receiver tube 54. This slight mismatch in weight, and any frictional properties of the pulley 66, result in the counter weight system 50 gradually elevating the rake 14. Thus, the counter weight 58 gradually overcomes inertia and builds momentum, causing the rake 14 to gradually elevate from the container 34. The gradual elevation of the rake 14 advantageously prevents any surprise or injury, which may result from a rapidly ejecting rake 14.

It is of course understood that the rake 14 may be elevated with any type of lifting mechanism. In addition, the rake 14 may be selectively elevated in different ways depending on the latching mechanism. For example, if a two-way latch or pressure sensitive latch 154 is used, a downward force may be applied to the head 26 of the rake 14 causing the two-way latch or the pressure sensitive latch 154 to release.

The underground rake storage or device of the present invention provides significant advantages, including both substantially concealing the rake 14, and selectively elevating the rake to a convenient grasping elevation. Disposing the rake 14 in container 34 underground reduces the risk that the rake 14 or container 34 will interfere with a golf ball or play of the game. Providing the container 34 flush with the surface 18 allows the location of the rake 14 to be easily ascertained, when needed. The underground rake storage system or device of the present invention has a low profile which maintains the esthetic appearance of the golf course, reduces the need for maintenance workers to move rakes during maintenance of the course, reduces the risk of broken rake handles, protects fiberglass rake handles from sunlight, and reduces the risk of injury.

In addition, elevating the rake 14 reduces the need for the golfer or user to bend over, squat, or kneel in order to retrieve the rake 14. The movement of the rake 14 as it is elevated is graceful and sophisticated, adding to the esthetics of the golf course and the convenience of the players. In addition, the latching mechanism allows the player or user to selectively elevate the rake from a standing position.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A rake storage device configured to store a rake adjacent a sand trap of a golf course, and configured to selectively elevate the rake for use, the device comprising:

a) an elongated container configured to be disposed underground adjacent the sand trap in a substantially vertical orientation, and configured to receive the rake therein; and b) a lifting mechanism, disposed in the elongated container, configured to elevate the rake and having:

1) a receiver, movably disposed in the elongated container, configured to receive the rake; and 2) a counter-weight, operatively coupled to the receiver and movably disposed in the elongated container, configured to elevate the receiver and the rake.

2. A device in accordance with claim 1, further comprising:

a) a pulley, disposed within the elongated container; and b) a cord, movably engaging the pulley and attached to the receiver and the counter-weight.

3. A device in accordance with claim 1, wherein the lifting mechanism elevates a head of the rake to a grasping elevation greater than approximately two feet.

4. A device in accordance with claim 1, wherein the lifting mechanism moves the rake between 1) a storage elevation in which the rake is disposed underground and within the container, and 2) a graspable elevation in which the head is disposed out of the container and above the ground.

5. A rake storage system configured to store a rake adjacent a sand trap of a golf course, and configured to selectively elevate the rake for use, the device comprising:

a) an elongated container configured to be disposed underground in a substantially vertical orientation; adjacent a sand trap of a golf course;

b) a rake, removably disposed within the elongated container, having a longitudinal axis; and c) means, located within the elongated container, for elevating the rake along the longitudinal axis of the rake, and in a substantially vertical direction.

6. A system in accordance with claim 5, wherein the means for elevating the rake includes a counter-weight.

7. A system in accordance with claim 5, wherein the means for elevating the rake includes elevating a head of the rake to a grasping elevation greater than approximately two feet.

8. A system in accordance with claim 5, wherein the means for elevating the rake includes:

a) a receiver, slidably disposed in the container, configured to receive a handle of the rake therein; and b) a counter weight, operatively coupled to the receiver, having a weight greater than a combined weight of the receiver and the rake.

9. A system in accordance with claim 8, wherein the means for elevating the rake further includes:

a) a pulley, disposed within the container; and b) a cord, movably engaging the pulley and attached to the receiver and the counter-weight.

10. A system in accordance with claim 5, wherein the means for elevating the rake includes moving the rake between 1) a storage elevation in which the rake is disposed underground and within the container, and 2) a graspable elevation in which the head is disposed out of the container and above the ground.

11. A system in accordance with claim 5, further comprising:

a) means for selectively retaining the rake within the container, and for selectively activating the means for elevating.

12. A rake storage system configured to store a rake adjacent a sand trap of a golf course, and configured to selectively elevate the rake for use, the device comprising:

a) an elongated container configured to be disposed underground adjacent the sand trap in a substantially vertical orientation;

b) a rake, removably disposed within the elongated container;

c) a lifting mechanism, disposed in the elongated container, configured to elevate the rake; and d) retaining means for selectively retaining the rake in the container.

13. A system in accordance with claim 12, wherein the retaining means includes a bi-stable mechanism.

14. A system in accordance with claim 12, wherein the retaining means includes a two-way latch.

15. A system in accordance with claim 12, wherein the retaining means includes a pressure release catch.

16. A system in accordance with claim 12, wherein the retaining means includes:

a) a bi-stable mechanism, disposed in the container and engagable by the rake, and movable between 1) a secure position in which the mechanism retains the rake within the container, and 2) an open position in which the mechanism allows the rake to be removed from the container.

17. A system in accordance with claim 12, wherein the retaining means includes:

a) a pivot member, pivotally coupled to the container and engagably by the rake; and b) a spring element, disposed in the container and engagably by the pivot member, to bias the pivot member between two positions including 1) a secure position in which the member retains the rake within the container, and 2) an open position in which member allows the rake to be removed from the container.

18. A system in accordance with claim 12, further comprising:

a) a lid, pivotally coupled to the container.

19. An underground rake storage system configured for use with a sand trap of a golf course, the system comprising:

a) a rake configured to rake the sand trap and having:

1) a handle with proximal and distal ends; and 2) a head disposed on the distal end;

b) an elongated container, configured to removably receive the rake therein, and configured to be disposed underground in a substantially vertical orientation, the container having:

1) a main tube configured to receive the handle of the rake; and 2) a tray, disposed on the main tube, configured to receive the head of the rake; and c) a lifting mechanism, disposed in the container, configured to vertically elevate the rake and having:

1) a receiver, sidably disposed in the main tube, configured to receive the proximal end of the handle of the rake therein; and 2) a counter weight, operatively coupled to the receiver, having a weight greater than a combined weight of the receiver and the rake.

20. A system in accordance with claim 19, further comprising:

a) a latching mechanism, disposed in the container, configured to releasably secure the rake in the container.

21. A system in accordance with claim 19, further comprising:

a) a pressure release catch, disposed in the bottom of the main tube, to engage and releasably secure the receiver in the tube.

22. A system in accordance with claim 19, further comprising:

a) a bi-stable mechanism, disposed in the container and engagable by the rake, and movable between 1) a secure position in which the mechanism retains the rake within the container, and 2) an open position in which the mechanism allows the rake to be removed from the container.

23. A system in accordance with claim 19, further comprising:

a) a pivot member, pivotally coupled to the container and engagably by the rake; and b) a spring element, disposed in the container and engagably by the pivot member, to bias the pivot member between two positions including 1) a secure position in which the member retains the rake within the container, and 2) an open position in which the member allows the rake to be removed from the container.

24. A system in accordance with claim 19, further comprising:

a) a guide tube, disposed in the main tube; and wherein the receiver is slidably disposed in the guide tube.

25. A system in accordance with claim 19, further comprising:

a) a pulley, disposed within the container; and b) a cord, movably engaging the pulley and attached to the receiver and the counter-weight.

26. A system in accordance with claim 19, wherein the lifting mechanism elevates the rake along a longitudinal axis of the rake and in a substantially vertical direction.

27. A system in accordance with claim 19, wherein the lifting mechanism moves the rake between 1) a storage elevation in which the rake is disposed underground and within the container, and 2) a graspable elevation in which the head is disposed out of the container and above the ground.

28. A system in accordance with claim 19, wherein the lifting mechanism elevates a head of the rake to a graspable elevation greater than approximately two feet.

29. A system in accordance with claim 19, further comprising:

a) a lid, pivotally coupled to the container.

30. A method for substantially concealing and selectively providing a rake adjacent a sand trap of a golf course, the method comprising the steps of:

a) providing an elongated container configured to be disposed underground adjacent a sand trap of a golf course in a substantially vertical orientation;

b) selectively disposing a rake in the container such that the rake is disposed underground in a substantially vertical orientation; and c) selectively elevating the rake out of the container in a substantially vertical direction by lifting a mechanism disposed within the elongated container, and substantially along a longitudinal axis of the rake.

31. A method in accordance with claim 30, wherein the step of selectively elevating the rake out of the container further includes elevating a head of the rake to a grasping elevation greater than substantially two feet.

32. A method in accordance with claim 30, wherein the step of selectively elevating the rake out of the container further includes elevating the rake with a counter-weight.

33. A method in accordance with claim 30, further comprising the step of:

a) selectively retaining the rake within the container with a bi-stable mechanism.

* * * * *